US005182057A

United States Patent [19]

Johnson

[11] Patent Number: 5,182,057

[45] Date of Patent: Jan. 26, 1993

[54] METHOD FOR IN SITU DISPENSING OF CEMENTITIOUS MATERIALS AT REMOTE LOCATIONS

[76] Inventor: Robert J. Johnson, 4221 C.R. 20, Ada, Ohio 45810

[21] Appl. No.: 815,074

[22] Filed: Dec. 27, 1991

[51] Int. Cl.[5] ..... B28B 13/00; B65D 47/00; E02D 5/34; E04B 1/16

[52] U.S. Cl. ..... 264/31; 222/181; 222/561; 264/35; 404/108; 405/233; 414/608; 414/725; 414/786; 425/62; 425/447

[58] Field of Search ..... 264/31-35; 405/233; 222/181, 504, 561; 414/725, 786, 608; 404/108; 425/62, 447

[56] References Cited

U.S. PATENT DOCUMENTS

| | | | |
|---|---|---|---|
| 2,937,429 | 5/1960 | Livingston | 425/62 X |
| 3,543,960 | 12/1970 | Wagner | 414/725 X |
| 3,834,595 | 9/1974 | Brock et al. | 222/504 |
| 4,073.410 | 2/1978 | Melcher | 222/181 |
| 4,144,980 | 3/1979 | Meyer | 414/725 |
| 4,259,282 | 3/1981 | Goldsmith | 264/148 |
| 4,295,779 | 10/1981 | Shumaker | 414/685 |
| 4,302,127 | 11/1981 | Hodson | 404/108 X |
| 4,310,293 | 1/1982 | Eggleton | 425/62 |
| 4,475,672 | 10/1984 | Whitehead | 222/561 |
| 4,566,823 | 1/1986 | May | 425/62 X |

FOREIGN PATENT DOCUMENTS

| | | | |
|---|---|---|---|
| 1546354 | 2/1990 | U.S.S.R. | 222/561 |

*Primary Examiner*—Karen Aftergut
*Attorney, Agent, or Firm*—Mueller and Smith

[57] ABSTRACT

A method for the facile filling of remotely located forms with cementitious materials. The method uses a transportable bin which is captively coupled to the arms of a skid loader. The bin includes a generally rectangular container having four vertical sides and an accessible interior truncated at a base and having a covered dispensing aperture at the bottom. The covered aperture is adapted to be actuable in situ by the skid loader operator using controls located within reach of the operator when the aperture is vertically disposed over a form to be filled.

7 Claims, 2 Drawing Sheets

METHOD FOR IN SITU DISPENSING OF CEMENTITIOUS MATERIALS AT REMOTE LOCATIONS

BACKGROUND

This invention relates in general to the delivery and dispensing of cementitious materials, such as concrete, at remote locations which may not be accessible by conventional concrete delivery methods.

Concrete is typically delivered to a work site by a concrete truck which has been loaded with material at a remotely located mixing facility. Concrete trucks are relatively large and are thereby inherently limited in their ability to deliver mixed material to its final destination where it is dispensed into forms constructed of wood or other material or earthen forms, such as trenches or holes. Even if the final destination is accessible, the delivery system of a cement truck may not be efficient in terms of lost time and wasted material.

Heretofore, whenever it was desired to deliver concrete to an area that was inaccessible by a cement delivery truck, several methods may have been employed. One method was to load the bucket of a front end loader with concrete for delivery to the form. However, even after the loader arrived at the form the material still had to be dispensed which typically required additional labor to shovel or otherwise offload the material from the bucket of the loader into the form. This was particularly true when the pre-existing form was a fencepost hole which could not be filled from the bucket of a front end loader without incurring an unacceptable amount of waste. Even if the destination were accessible by a front end loader, the amount of material carried in its bucket was limited by a number of variables including the terrain over which the loader had to travel to get to its final destination, the weight of the loader, the amount of offloading labor available, the amount of finishing labor available, etc.

Another method of delivering material to a form or fencepost hole was via hand carried buckets filled with mixed material. This method of delivery was required when delivery was needed in areas having steep hills or swampy terrain. While the use of hand carried buckets has provided for the accurate placement of materials into forms and fencepost holes, it is both time consuming and labor intensive.

One major disadvantage of previous methods of concrete delivery is the inefficient use of labor resources. Since the amount of time available to deliver and finish concrete material is determined by the set up time of the material, the laborer placing the material in a form may not be the same party. This is particularly true, for example, in filling fencepost holes where there is a multitude of forms which must be filled over an extended distance. When the delivery of materials is slow, the finishing of those materials by others must necessarily wait. The inefficient use of finishing labor represents a wasted resource which must be accounted for in the overall cost of performing the task. Also, since the installation of the woven fence fabric proceeds faster than the current method of setting fenceposts, fence stretching crews may very well catch up with the setting crew and have to wait idly by until additional posts have been set.

In addition to wasting human resources, prior methods of concrete delivery to remote locations are generally not cost effective since less than complete loads of concrete must be ordered. Ordering less than minimum material loads often incurs a delivery charge by the concrete supplier which also must be accounted for in the overall cost of the project.

An improved method of delivering concrete or other cementitious materials to remote locations would provide a more effective means for delivering and dispensing of concrete within the setup time of the material, would accommodate delivery over variable terrain, and would significantly improve upon the use of human and material resources.

SUMMARY OF THE INVENTION

It is therefore a feature of the invention to provide a method for the facile filling of forms with cementitious material at remote locations, which comprises the steps of:

filling a transportable bin with said material, the bin comprising:

a container having an accessible interior truncated at a base, the base having a coverable aperture; a remotely and host transport apparatus operator actuable door covering the aperture for selectively dispensing the material through the aperture; and coupling means for attaching the bin to an articulated arm of a host transport apparatus;

moving the host transport apparatus into a position where the actuable door is vertically disposed above a form; and actuating the door by the operator for a time sufficient for dispensing a determined amount of the cementitious material through the aperture into the form.

As another feature, the invention provides a transportable bin couplable to a host transport apparatus and which is adapted to receive cementitious material for delivery to a remote location for the facile filling of forms. The bin comprises a generally rectangular container having four vertical sides and an accessible interior truncated at a base and having a coverable aperture. The bin also includes a remotely actuable door for covering the aperture for retaining the received cementitious material within the bin. An actuating mechanism is provided for selectively actuating said door allowing the material to be dispensed from the bin. A coupling bracket is also provided for coupling the bin to a front arm of a host transport apparatus.

DETAILED DESCRIPTION OF THE INVENTION

The apparatus and method of the present invention may be employed in a variety of applications where it is desired to deliver cementitious materials, such as concrete, to a remotely located destination. Such a destination may include prepared forms or trenches at either indoor and outdoor locales. However, for the purpose of the instant description, the method and apparatus for remote delivery of cementitious materials are disclosed in conjunction with the delivery of concrete to prepared earthen fencepost holes.

Figure 1:
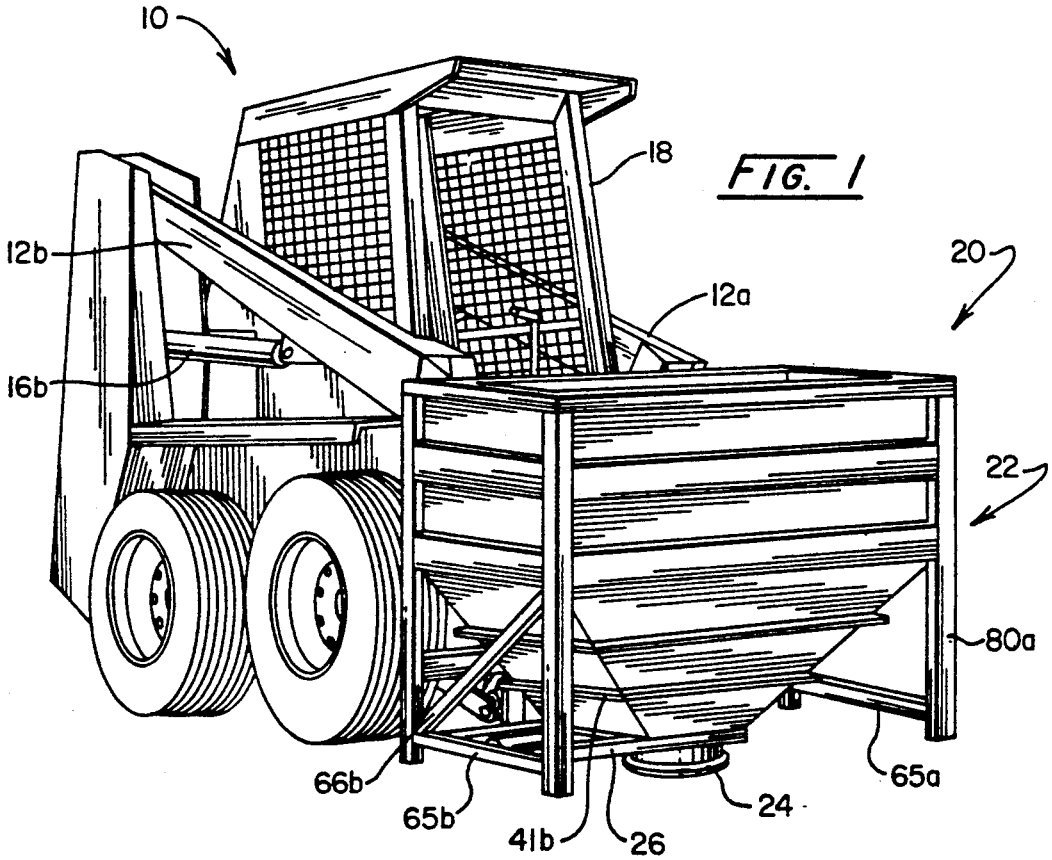
FIG. 1 is general arrangement depicting the apparatus of the present invention coupled to the front arms of a skid loader.

Referring to FIG. 1 a skid loader 10 is depicted having arms 12*a* and 12*b* coupled to a delivery bin 20. The delivery bin 20 is shown at rest on its frame 22 at the foremost position of skid loader 10. So oriented, it appears that from an operator's standpoint from within the cab 18 of the skid loader 10, the operator can maintain a direct observation of the orientation of the chute 24 of the delivery bin 20. This line of sight is readily seen from FIG. 2 which shows the bin 20 coupled to a front arm 14 of skid loader 10 by way of mounting bracket 30*a*.

Figure 3:
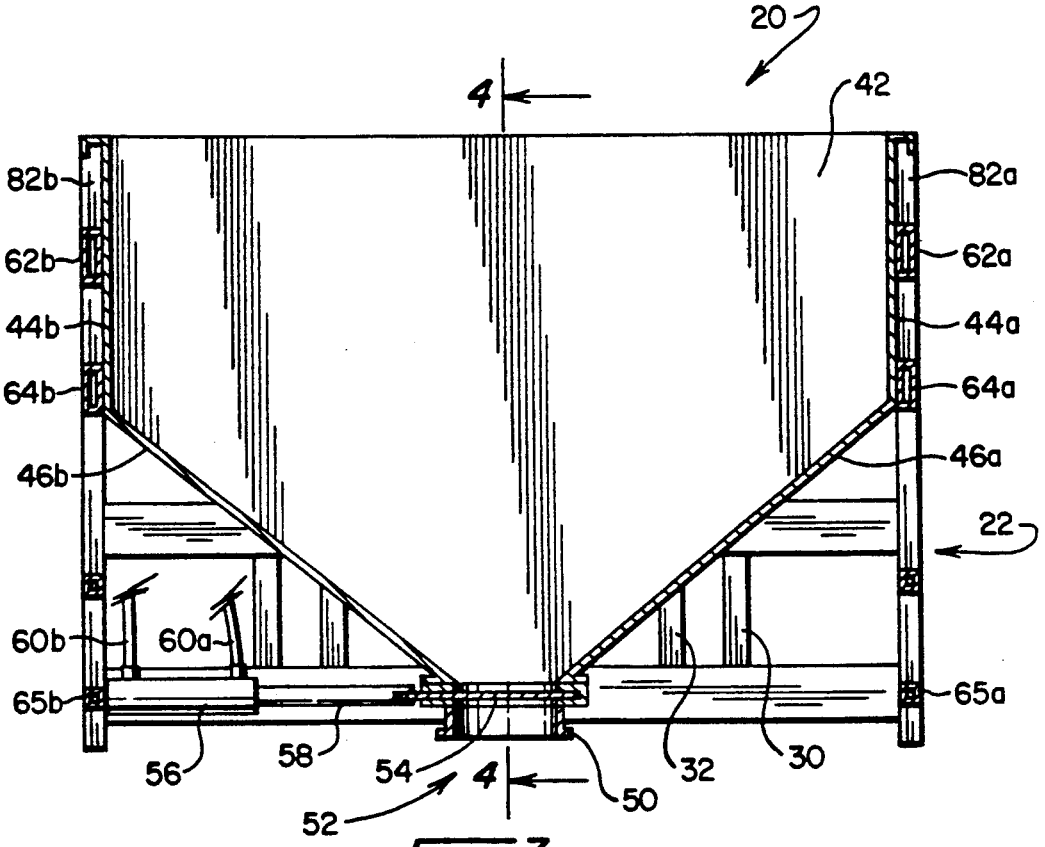
FIG. 3 is a cross-sectional view of the apparatus of the present invention taken through section 3—3.
Figure 4:
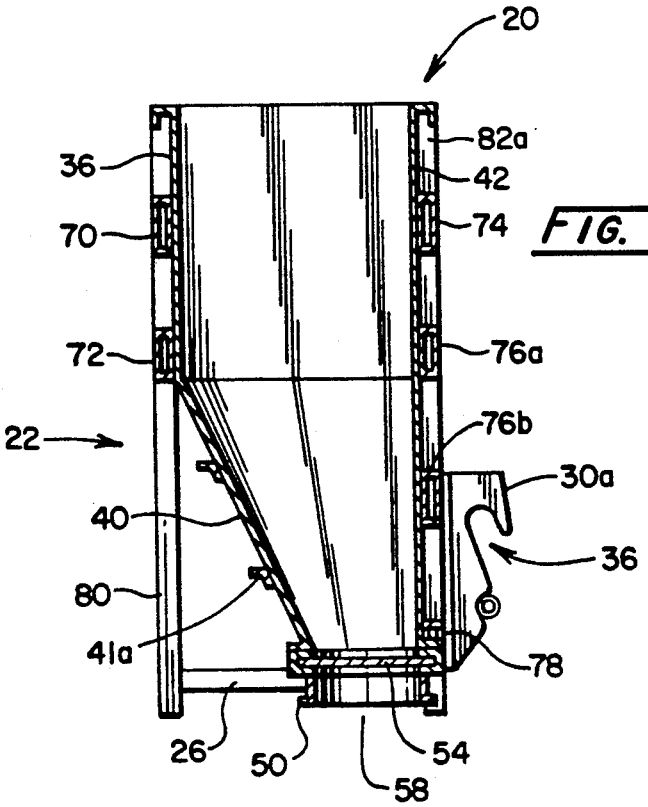
FIG. 4 is a cross-sectional view of the apparatus of the present invention taken through section 4—4.

Section 3—3 is shown in FIG. 3. There it can be seen that the interior of bin 20 is generally rectangular formed by a rear vertical wall 42, vertical sidewalls 44*a* and 44*b* and vertical front wall 38, as shown in FIG. 4. In the preferred embodiment bin interior is also comprised of slope sidewalls 46*a* and 46*b*, and a sloped front wall 40 which walls are inwardly and downwardly directed towards an aperture 52 at the bottommost section of the bin 20 interior. Although not depicted, bin 20 may be fitted with a lid mechanism to isolate its contents from environmental elements and to prevent its contents from sloshing over its sides during transport to a remote delivery site.

Located between the aperture 52 and the chute 50 is an operator actuable door 54 which is horizontally supported by door slide 26. During operation, the door 54 is maintained in a closed position thus retaining the contents within bin 20 until selectively actuated by an operator at the determined material delivery location. Coupled to the door 54 is a hydraulic cylinder arm 58 which is actuable by hydraulic cylinder 56. Inlet and outlet hoses are shown at 60*a* and 60*b* which are terminated with quick-connect fittings (not shown) and hydraulically coupled to the hydraulic system of the host transport apparatus 10. As is well known in the art, transport devices, such as a front skid loader 10, are typically fitted with hydraulic take-off points and the associated controls for accommodating auxiliary hydraulic devices. While the preferred embodiment of the invention employs a hydraulic cylinder 56 coupled to the hydraulic system of the skid loader 10 to actuate the aperture door 54, it is anticipated that other suitable means for actuating the door 54 may be employed, including mechanical, electrical, or pneumatic arrangements.

It is anticipated that the body of bin 20 will be constructed of metal having a gage suitable for retaining a cementitious cargo weighing as much as two tons. It is also anticipated that the interior surface of the body of bin 20 may be covered with a coating to prevent adhesion thereto by the cementitious materials contained therein and that such a coating would also promote the gravity-fed flow of the materials from the interior of the bin 20.

Figure 2:
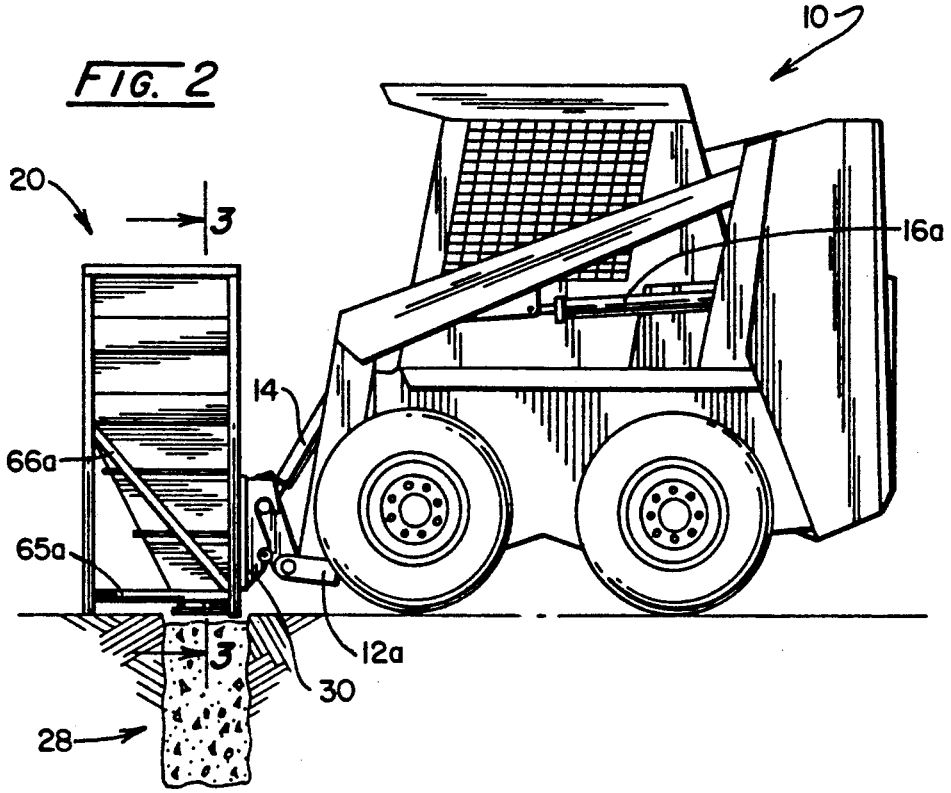
FIG. 2 is a side elevation of the apparatus of the present invention coupled to the front arms of a skid loader.

Referring to FIGS. 1, 3 and 4, the body of bin 20 is housed within the frame 22 which is comprised of 4 vertical members 80*a*, 80*b*, 82*a* and 82*b*. Vertical frame members 80*a*, 82*a* and 80*b*, 82*b*, are joined by side horizontal frame members 62*a*, 64*a*, 65*a* and 62*b*, 64*b* and 65*b* respectively. In addition, frame members 80*a*, 80*b* and 82*a*, 82*b* are joined by front horizontal frame members 70, 72 and rear horizontal frame members 74, 76*a*, 76*b*, 78 respectively. To provide additional stability, side cross braces 66*a* and 66*b* are provided. Referring additionally to FIGS. 1 and 2, horizontal reinforcing ribs, such as at 41*a* and 41*b*, are shown attached to the outer faces of sloped side walls 46*a*, 40 and 46*b* to provide additional structural support over their otherwise unsupported spanse.

As previously noted, the body of bin 20 truncates in an aperture 52 which is coverable by an operator-actuable door 54. In the preferred embodiment, an extending chute 50 is provided enabling an operator to both visually align the aperture 52 over a form or other hole, such as at 28 in FIG. 2, and to accurately direct the gravity fed flow of the dispensed material. It is additionally anticipated that the gravity fed flow of materials from bin 20 may be assisted by mechanical or vibrational means. Since the utility of the invention is proportional to the capacity of bin 20, it is desirable that the center of gravity of a loaded bin 20 be kept close the center of gravity of the skid loader 10. Sloping the side walls 46*a*, 46*b* and 40 towards an aperture 52 located toward the rearmost portion of bin 20, places the center of gravity of the concrete laden bin 20 closest to that of the skid loader 10. While the aperture 52 is shown to be generally centered between side walls 44*a* and 44*b*, it is anticipated that other applications may suggest that the aperture 52 be located off center.

Referring now to FIGS. 2, 3, and 4, mounting brackets 30*a*, 32*a* and 30*b*, 32*b* are shown. When coupled to the front arms 12*a*, 12*b* of a skid loader 10 a hooked portion 36 engages horizontal pin portions of front arms 12*a*, 12*b*. When the mounting brackets, such as at 30*a*, 30*b*, 32*a* and 32*b*, are hookingly engaged with the front arms 12*a*, 12*b* of a skid loader 10, locking pins (not shown) are inserted into locking pin retainers, such as at 33, for captively retaining the bin to the front arms 12*a*, 12*b* of the skid loader 10. In a preferred embodiment, the mounting brackets, as at 30*a*, 30*b*, 32*a* and 32*b* will be affixed as low as possible on the rear of the bin frame 22, allowing the bin 20 to be tilted back (i.e., past vertical) towards the skid loader 10 during transport, thus adding to the stability of the combination by a rearward shift of the center of gravity.

During operation, a bin 20 coupled to a skid loader 10 will be presented to a cement truck (not shown) to receive a load of concrete or other cementitious material. The bin 20, resting on the legs of its frame 22, is filled with material. Once loaded, the bin 20 is raised by arms 12*a*, 12*b* and then moved into a position by skid loader 10. During transport over unlevel terrain, the horizontal orientation of bin 20 may be maintained by selective actuation of front cylinder 14. Once at the delivery site, the aperture 52 of bin 20 is positioned by the operator vertically above the form or other hole 28 which is to be filled with the cementitious material. After the aperture 52 has been properly aligned over the hole 28, the operator lowers the bin 20 via skid loader arms 12*a*, 12*b* and actuates the door 54 covering said aperture 52, opening the door 54 for a time sufficient to dispense a determined amount of concrete through the aperture 52 into the form 28. In the case of filling fence post holes, an operator would typically orient the skid loader 10 to straddle a proposed fence line and then proceed to successively repeat the process by positioning the bin 20 over and depositing a determined amount of material in each succeeding hole 28 in the fenceline. Since location of the bin 20 at the front of the skid loader 10 enables an operator to visually align its aperture 52 over a small target, such as a fence post hole 28, and permits him to observe the rate of dispensed material without the aid of others, a single skid loader operator can effectively perform a task that heretofore required more than one person.

The ability to articulate the front arms 12*a*, 12*b* of skid loader 10 allows a loaded bin 20 to be tilted forward during a hill climb thus shifting the center of gravity forward. This makes a hill climb by skid loader 10 bearing a loaded bin 20 much easier.

The invention can employ either foam filled tires or steel tracks installed over the tires of the skid loader 10, it being understood that the foam filling of the tires lowers the center of gravity thus adding to the stability of the bin 20 bearing skid loader. Adding steel tracks over the skid loader 10 tires increases traction and serves to protect the tires from certain environmental hazards such as sharp rocks. Adding tracks to the tires also enables the skid loader 10 to traverse terrain and deliver concrete to areas that would otherwise be inaccessible to such a transport vehicle.

Since certain changes may be made in the above described apparatus and method without departing from the scope the invention herein involved, it is intended that all matter contained in the above description or shown in the accompanying drawings shall be interpreted as illustrative and not in a limiting sense.

I claim:

1. A method for facile filling of forms with cementitious material at remote locations by an operator of a host transport apparatus, which host transport apparatus has an articulated arm and a cab in which is stationed said operator, which comprises the steps of:

filling a transportable bin with said material, said bin being attaches to said host transport apparatus and comprising:

a container having an accessible interior truncated at a base which base has a coverable aperture;

a remotely and host transport apparatus operator actuable door covering said aperture for selectively dispensing said material through said aperture; and coupling means for attaching said bin to said articulated arm of said host transport apparatus;

moving said host transport apparatus having said bin attached thereto into a position where said actuable door covering said aperture of said bin is vertically disposed above a form at a remote location; and actuating said door by said operator stationed in said cab for a time sufficient for dispensing a determined amount of said cementitious material through said aperture into said form at said remote location.

2. The method of claim 1 wherein said host transport apparatus is a skid loader.

3. The method of claim 1 wherein said forms are holes for fenceposts.

4. The method of claim 3 wherein said holes are located adjacent to a roadway.

5. The method of claim 1 wherein said bin is coupled to a front arm of said host transport apparatus.

6. The method of claim 1 wherein said cementitious material is moved into position by a host transport apparatus having foam-filled tires.

7. The method of claim 1 wherein said cementitious material is moved into position by a host transport apparatus having tracks.

* * * * *